US005293096A

United States Patent [19]

Nakamura

[11] Patent Number: 5,293,096

[45] Date of Patent: Mar. 8, 1994

[54] CATHODE RAY TUBE DEVICE HAVING INSULATOR COATING

[75] Inventor: Kouji Nakamura, Nagaokakyo, Japan

[73] Assignee: Mitsubishi Denki Kabushiki Kaisha, Tokyo

[21] Appl. No.: 892,769

[22] Filed: Jun. 3, 1992

[30] Foreign Application Priority Data

Jun. 13, 1991 [JP] Japan ..... 3-141532

[51] Int. Cl.[5] ..... H01J 29/88

[52] U.S. Cl. ..... 313/477 R; 220/2.3 A; 313/377

[58] Field of Search ..... 313/477 R, 477 HC; 220/2.3 A

[56] References Cited

U.S. PATENT DOCUMENTS

| | | | |
|---|---|---|---|
| 2,132,783 | 10/1938 | Goldmark | 313/477 X |
| 2,222,197 | 11/1940 | Engels | 313/477 |
| 2,682,963 | 7/1954 | Faulkner | 220/2.3 A |
| 2,691,457 | 10/1954 | Longacre . | |
| 2,767,342 | 10/1956 | Anthony | 313/477 |
| 4,990,825 | 2/1991 | Tsukui et al. | 313/482 |

FOREIGN PATENT DOCUMENTS

| | | |
|---|---|---|
| 1062737 | 8/1959 | Fed. Rep. of Germany . |
| 61-181028 | 8/1986 | Japan . |
| 286033 | 3/1990 | Japan . |
| 586797 | 4/1947 | United Kingdom . |

OTHER PUBLICATIONS

Telefunken Manual: "Die Fernseh-Bildrohre", Franzis-Verlag Munchen, (1959), pp. 6 to 19; 33 to 34; 63 to 64 in connection with the diagram of the fabricration process.

*Primary Examiner*—Sandra L. O'Shea

[57] ABSTRACT

A CRT having a glass faceplate for forming an image display surface and a metal funnel connected to a peripheral part of the faceplate and forming a side wall. The glass faceplate has a phosphor screen coated on the inside surface and a metal film covering the phosphor screen. A high voltage of 25 KV is applied to the metal film, while the metal funnel is grounded. An insulating layer covers adjacent inside areas of the funnel and faceplate, thereby increasing the distance between the metal film and exposed surfaces of the funnel and preventing creeping discharges.

7 Claims, 3 Drawing Sheets

CATHODE RAY TUBE DEVICE HAVING INSULATOR COATING

BACKGROUND OF THE INVENTION

The present invention relates to a cathode ray tube device (hereinafter abbreviated as CRT) for picture display in a television set or the like.

Two desirable qualities for CRTs are high mechanical strength and lightweight. For this purpose, CRTs with funnels made of metal instead of glass are disclosed, for example, in Japanese Patent Kokai Publication 86033/1990. In these CRTS, a high voltage of 25 KV is applied to a thin metal film that covers the phosphor screen of the faceplate, while the metal funnel is grounded. Unfortunately, factors such as dirt on the inside surface of the faceplate and ambient electrons have caused serious problems of creeping discharge between the metal film and the metal funnel.

SUMMARY OF THE INVENTION

An object of the present invention is to provide a lightweight CRT that can avoid creeping discharge between the metal film and the metal funnel.

A CRT according to the present invention has a glass faceplate forming an image display surface, and a metal funnel connected to a peripheral part of the faceplate and forming a side wall. The inside surface of the glass faceplate has a phosphor screen covered by a metal film. The CRT also has an insulating layer covering mutually adjacent inside areas of the funnel and the faceplate.

A method for manufacturing a CRT comprises the steps of preparing a glass faceplate having a phosphor screen covered by a metal film, and preparing a metal funnel. The method also comprises the steps of applying a first glass solder paste to a peripheral surface of the glass faceplate and an edge part of the funnel, and placing the faceplate and the funnel on a supporting stand so that the surface and part coated by the first glass solder paste are in contact. The method further comprises a step of applying a second glass solder paste mutually adjacent inside areas of the funnel and faceplate, and a single step of heating the above components, thereby sintering both the first and second glass solder pastes.

DETAILED DESCRIPTION OF THE PREFERRED EMBODIMENTS

Preferred embodiments of the present invention will now be described with reference to the drawings.

Figure 1:
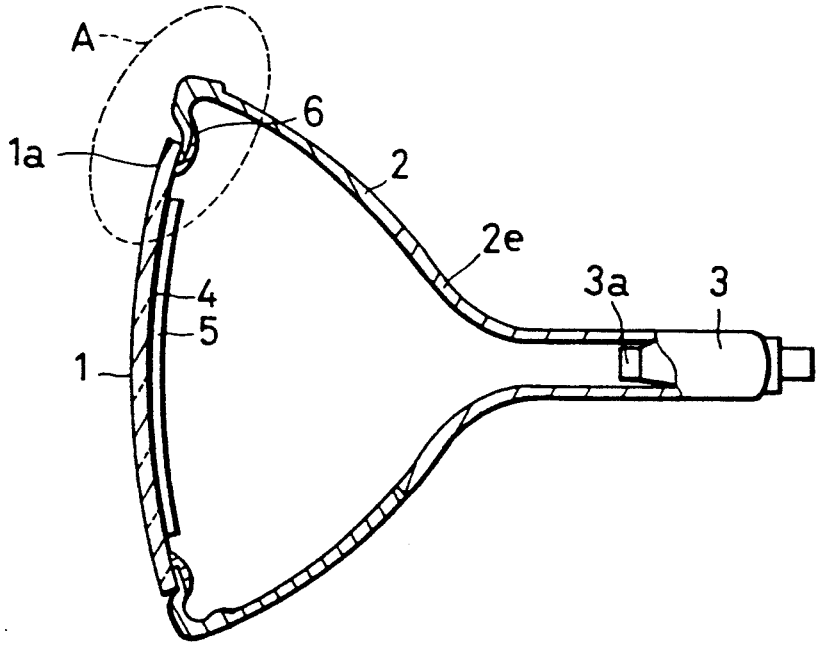
FIG. 1 is a sectional side view of an embodiment of the present invention.
Figure 2:
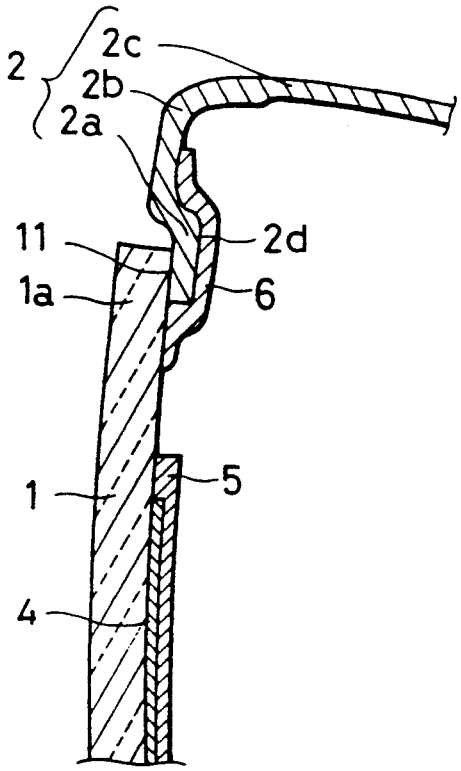
FIG. 2 is an enlarged view of part A in FIG. 1.

As shown in FIGS. 1 and 2, the CRT of the first embodiment comprises a glass faceplate 1 forming an image display surface and a metal funnel 2 joined to the peripheral part 1*a* of the faceplate 1 and forming a side wall. The faceplate 1 is made of a glass such as the H8602 material specified by the Electronic Industries Association of Japan (EIAJ). The funnel 2 is made of a steel such as SUS410 which has a very low rate of outgassing in a vacuum and a thermal expansion coefficient close to that of the glass faceplate 1. The funnel 2 has an edge part 2*a* adjacent to the peripheral part 1*a* of the faceplate 1, a side wall 2*c*, and a bent part 2*b* connecting the edge part 2*a* to the side wall 2*c*. The edge part 2*a* of the funnel 2 is joined to an inside surface of the peripheral part 1*a* of the faceplate 1 by glass soldering using frit glass 11. The edge part 2*a* and the bent part 2*b* are thicker than the side wall 2*c*, because large tensile stress occurs in the bent part 2*b*. The extra thickness increases the mechanical strength of the bent part 2*b*, thus protecting the CRT against implosion. Because only the bent part 2*b* and the edge part 2*a* are thickened, the CRT is lightweight.

The CRT also comprises a glass cone part 2*e* connected at the rear extremity of the funnel 2, and a deflection yoke (not shown in the drawings) which is mounted externally around the cone part 2*e* and deflects an electron beam.

The CRT also comprises a glass neck 3 connected at the rear extremity of the cone part 2*e* and an electron gun 3*a* contained in the neck 3 and facing the faceplate 1.

The CRT furthermore comprises a phosphor screen 4 coating part of the inside surface of the faceplate 1 and a metal film 5 covering the phosphor screen 4. The metal film 5 is made, for example, by evaporation deposition of aluminum. In the CRT, a high voltage of 25 KV is applied to the metal film 5, while the metal funnel 2 is grounded.

A novel feature of this CRT is an insulating layer 6 that covers mutually adjacent inside portions of the faceplate 1 and the funnel 2. The funnel portion 2*d* covered by the insulating layer 6 includes, in FIG. 2, the entire edge part 2*a* and a portion of the bent part 2*b*. The insulating layer 6 is made of a frit glass, preferably a heat-resistant material. The insulating layer 6 lengthens the distance between the metal film 5 and the exposed surface of the funnel 2, thereby preventing dirt on the inside surface of the faceplate 1 or ambient electrons from causing creeping discharge from the metal film 5 to the funnel 2.

Figure 3:
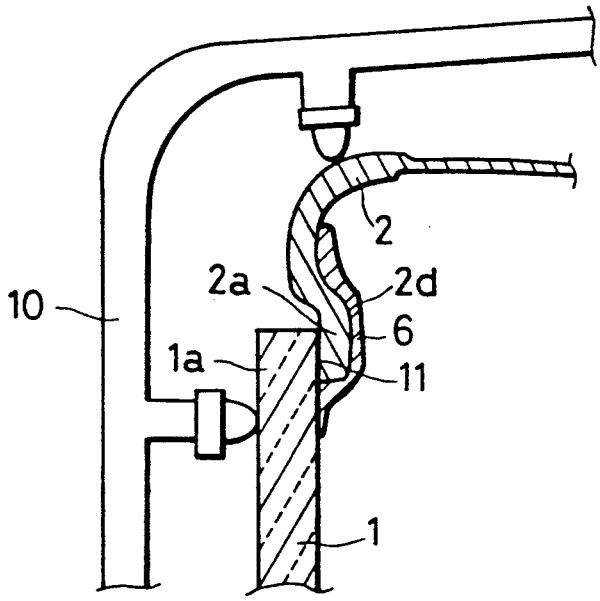
FIG. 3 is a diagram for explaining a method for manufacturing the CRT of FIG. 1.

A method for manufacturing the CRT of FIG. 1 will be described below with reference to FIG. 3. FIG. 3 shows a supporting stand 10 which contains and supports the components such as the faceplate 1 and funnel 2 at fixed and desired positions.

First, the phosphor screen 4 is applied to an inside surface of the glass faceplate 1 and coated by the metal film 5, and the metal funnel 2 is prepared. Next, a first glass solder paste 11 is applied to at least one surface of the peripheral part 1*a* of the faceplate 1 and the edge part 2*a* of the funnel 2 and allowed to dry. The first glass solder paste 11 is a mixture of frit glass and solvent, the solvent being a mixture of nitrocellulose and iso-amylacetate. Next, the faceplate 1 and the funnel 2 are placed at a desired position on the supporting stand 10 so that portions covered by the first glass solder paste 11 are in contact. Next, a second glass solder paste is applied to an inside area 2*d* of the funnel 2 and the adjacent part of the faceplate 1, to form an insulating layer 6. The second glass solder paste comprises the same mixture of frit glass and solvent as the first glass solder paste. Next, the above components fixed on the supporting stand 10 are heated to a temperature of 430° C. for one hour, thereby sintering the first glass solder paste 11 and the second glass solder paste forming the insulating layer 6.

An advantage of this method is that one heating step performed, thereby simplifying the manufacturing process.

Figure 4:
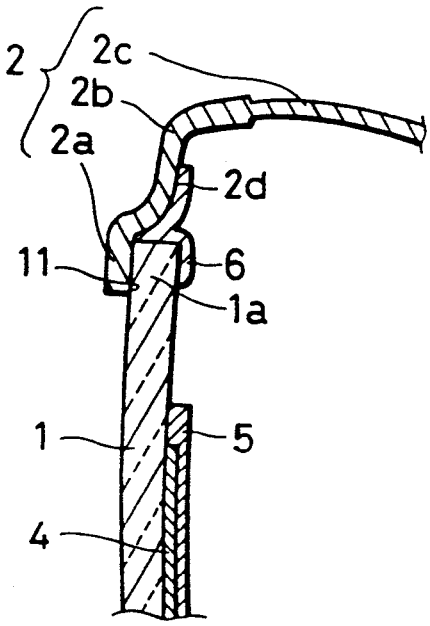
FIG. 4 is a partial sectional side view of an another embodiment.

FIG. 4 is a partial sectional side view of an another embodiment. Elements in FIG. 4 corresponding to elements in FIG. 2 have the same reference numerals. In this CRT, the edge part 2*a* of the funnel 2 is joined to the outside surface of the faceplate 1. Except for this difference, the CRT in FIG. 4 is the same as in FIG. 2.

Figure 5:
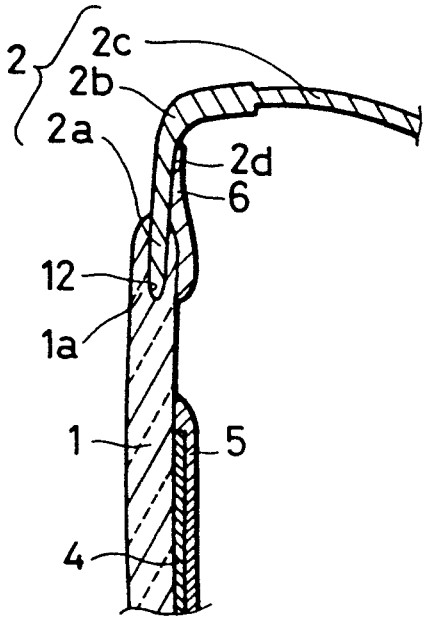
FIG. 5 is a partial sectional side view of a still another embodiment.

FIG. 5 is a partial sectional side view of still another embodiment. Elements in FIG. 5 corresponding to elements in FIG. 2 have the same reference numerals. In this CRT, the peripheral part 1*a* of the faceplate 1 has a groove 12 in its edge surface extending around the circumference of the faceplate 1, and the edge part 2*a* of the funnel 2 fits into the groove 12. Except for this difference, the CRT in FIG. 5 is the same as in FIG. 2.

Figure 6:
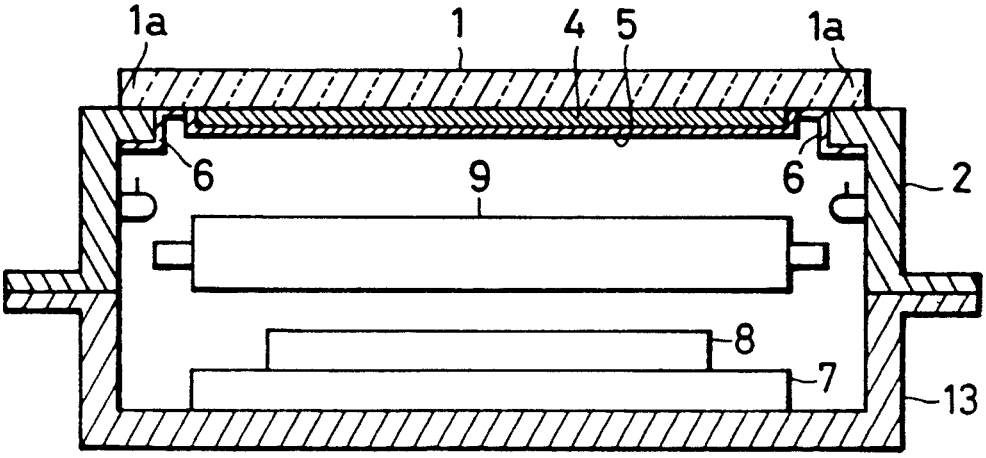
FIG. 6 is a sectional view of a yet another embodiment.

FIG. 6 is a sectional side view of yet another embodiment. FIG. 6 is a diagram schematically showing the flat-type CRT disclosed for example in Japanese Patent Kokai Publication 181028/1986. Elements in FIG. 6 corresponding to elements in FIG. 2 have the same reference numerals. In FIG. 6, numeral 7 denotes a cathode for emitting electrons, 8 denotes means for passing the electrons, 9 denotes a group of electrodes, and 13 denotes a rear wall connected to the rear end of the funnel 2.

In the embodiments of FIGS. 4 to 6, creeping discharge between the metal film 5 and the funnel 2 resulting from dirt on the inside surface of the faceplate 1 or ambient electrons can be prevented for the same reason as in the embodiment of FIG. 2.

What is claimed is:

1. A cathode ray tube for an image display comprising:

a glass faceplate forming an image display surface;

said metal funnel connected to a peripheral part of said faceplate and forming a side wall;

a phosphor screen coated on an inside surface of said faceplate;

a metal film covering said phosphor screen, said metal film being spaced from metal funnel along the peripheral part of said faceplate; and an insulating layer covering mutually adjacent inside areas of said metal film and said faceplate.

2. The cathode ray tube of claim 1, wherein said insulating layer is made of a frit glass.

3. The cathode ray tube of claim 1, wherein an edge part of said funnel is connected to said peripheral part of said faceplate by glass-soldering with a frit glass.

4. The cathode ray tube of claim 3, wherein said edge part of said funnel is connected to an inside surface of said faceplate.

5. The cathode ray tube of claim 3, wherein said edge part of said funnel is connected to an outside surface of said faceplate.

6. The cathode ray tube of claim 3, wherein said faceplate includes a circumferential groove along its edge surface for receiving a corresponding edge part of said metal funnel.

7. The cathode ray tube of claim 3, wherein said funnel includes a flanged portion for abutting said faceplate and a side wall portion said flanged portion being thicker than the side wall.

* * * * *

UNITED STATES PATENT AND TRADEMARK OFFICE

CERTIFICATE OF CORRECTION

PATENT NO. : 5,293,096

DATED : March 8, 1994

INVENTOR(S) : Kouji NAKAMURA

It is certified that error appears in the above-indentified patent and that said Letters Patent is hereby corrected as shown below:

Column 4, line 7, Claim 1, change "said metal funnel" to read --a metal funnel--;

Column 4, line 15, Claim 1, change "said metal film" to read --said metal funnel--;

Column 4, line 33, Claim 7, change "side wall portion" to read --side wall portion,--.

Signed and Sealed this

Ninth Day of January, 1996

Bruce Lehman

*Attest:*

BRUCE LEHMAN

*Attesting Officer*

*Commissioner of Patents and Trademarks*